US012692876B2

(12) United States Patent
Liu et al.

(10) Patent No.: US 12,692,876 B2
(45) Date of Patent: Jul. 28, 2026

(54) WATER PUMP HOUSING STRUCTURE

(71) Applicant: Delta Electronics, Inc., Taoyuan City (TW)

(72) Inventors: Chi-Ju Liu, Taoyuan City (TW); Meng-Yu Chen, Taoyuan City (TW); Shih-Han Huang, Taoyuan City (TW); Shih-Di Chen, Taoyuan City (TW)

(73) Assignee: DELTA ELECTRONICS, INC., Taoyuan City (TW)

( * ) Notice: Subject to any disclaimer, the term of this patent is extended or adjusted under 35 U.S.C. 154(b) by 6 days.

(21) Appl. No.: 18/901,378

(22) Filed: Sep. 30, 2024

(65) Prior Publication Data

US 2025/0297618 A1 Sep. 25, 2025

(30) Foreign Application Priority Data

Mar. 25, 2024 (CN) ..... 202420575474.8

(51) Int. Cl.
*F04D 29/58* (2006.01)
*F04D 13/06* (2006.01)

(52) U.S. Cl.
CPC ..... *F04D 29/5806* (2013.01); *F04D 13/0613* (2013.01); *F04D 13/0626* (2013.01); *F04D 13/064* (2013.01)

(58) Field of Classification Search
CPC ..... F04D 13/0606; F04D 13/0626; F04D 29/426; F04D 29/5806; F04D 29/5813
See application file for complete search history.

(56) References Cited

U.S. PATENT DOCUMENTS

2017/0302124 A1* 10/2017 Ehrsam ..... F04D 29/5813
2021/0388851 A1* 12/2021 Ikeda ..... H02K 9/227

* cited by examiner

*Primary Examiner* — Kenneth J Hansen
(74) *Attorney, Agent, or Firm* — MUNCY, GEISSLER, OLDS & LOWE, P.C.

(57) ABSTRACT

A water pump housing structure is provided, including a first housing, a second housing, a third housing, a rotor, and a stator. The first housing has an inlet. The second housing, along with the first housing, forms a flow passage. The flow passage is in fluid communication with the inlet and serves as a passage for fluid. The third housing has an inner surface and an outer surface. The inner surface, along with the second housing, forms a stator chamber. A fin structure is formed on the inner surface. The fin structure protrudes from the inner surface toward the stator chamber. The rotor is located inside the flow passage. The stator is located inside the stator chamber and drives the rotor to rotate.

20 Claims, 5 Drawing Sheets

WATER PUMP HOUSING STRUCTURE

CROSS REFERENCE TO RELATED APPLICATIONS

This application claims priority of China Utility Model application No. 202420575474.8, filed on Mar. 25, 2024, the entirety of which is incorporated by reference herein.

BACKGROUND OF THE INVENTION

Field of the Invention

The present invention relates to a water pump housing structure, and, in particular, to a water pump housing structure that has a fin structure.

Description of the Related Art

In traditional water pumps, heat accumulates inside the water pumps as the operating time increases, causing overheating problems. An overheated water pump has a shorter operating time and the operating efficiency of the water pump decreases over time.

It is known that the prior art includes using fin features on the outside of the water pump. However, this not only increases the manufacturing cost, but also fails to achieve the best cooling efficiency.

Therefore, it has become an important issue to enhance the cooling efficiency by disposing a fin structure inside the water pump close to where the heat is generated (e.g. magnetic poles).

BRIEF SUMMARY OF THE INVENTION

A water pump housing structure is provided in accordance with some embodiments of the present disclosure, including a first housing, a second housing, a third housing, a rotor, and a stator. The first housing has an inlet. The second housing, along with the first housing, forms a flow passage. The flow passage is in fluid communication with the inlet and serves as a passage for the fluid. The third housing has an inner surface and an outer surface. The inner surface, along with the second housing, forms a stator chamber. A fin structure is formed on the inner surface. The fin structure protrudes from the inner surface toward the stator chamber. The rotor is located inside the flow passage. The stator is located inside the stator chamber and drives the rotor to rotate.

In some embodiments, the rotor has an impeller portion and a rotor magnet portion. The impeller portion is linked to the rotor magnet portion.

In some embodiments, the stator comprises a stator magnetic pole that is located inside the stator chamber.

In some embodiments, the stator chamber is not in fluid communication with the flow passage.

In some embodiments, the first housing further comprises an outlet that is in fluid communication with the inlet via the flow passage.

In some embodiments, the water pump housing structure further includes a rotation shaft that is located at the center of rotation of the rotor. The rotation shaft is not synchronized with the rotor.

In some embodiments, the water pump housing structure further includes a circuit board that is located on the outer surface. The circuit board is electrically connected to the stator.

In some embodiments, the third housing further includes a peripheral portion that surrounds the inner surface. In some embodiments, the fin structure has a plurality of elongated portions, wherein every extending direction of the elongated portions is not perpendicular to the inner surface. Every proximal end of the elongated portions is away from the peripheral portion. Every distal end of the elongated portions is connected to the peripheral portion. In some embodiments, every elongated portion further includes a side portion. Each one of the proximal ends and each one of the distal ends are connected via the side portion. The side portions are connected to the inner surface.

A water pump housing structure is provided in accordance with some embodiments of the present disclosure, including a first housing, a second housing, a third housing, a rotor, and a stator. The first housing has an inlet. The second housing, along with the first housing, forms a flow passage. The flow passage is in fluid communication with the inlet and serves as a passage for fluid. The third housing has a first recess. The first recess, along with the second housing, forms a stator chamber. A fin structure is formed on a bottom surface of the first recess that faces the stator chamber. The fin structure protrudes from the bottom surface toward the stator chamber. The rotor is located inside the flow passage. The stator is located inside the stator chamber and drives the rotor to rotate.

In some embodiments, the water pump housing structure further includes a circuit board. The third housing further comprises an outer surface that is not inside the first recess. The circuit board is located on the outer surface. The circuit board is electrically connected to the stator.

In some embodiments, the first recess further includes a peripheral portion that surrounds the bottom surface. In some embodiments, the fin structure has a plurality of elongated portions. Every extending direction of the elongated portions is not perpendicular to the bottom surface. Every proximal end of the elongated portions is away from the peripheral portion. Every distal end of the elongated portions is connected to the peripheral portion. In some embodiments, every elongated portion further includes a side portion. Each one of the proximal ends and each one of the distal ends are connected via the side portion. The side portions are connected to the bottom surface.

BRIEF DESCRIPTION OF THE DRAWINGS

Aspects of the present disclosure are best understood from the following detailed description when read with the accompanying figures. It should be noted that, in accordance with the standard practice in the industry, various features are not drawn to scale. In fact, the dimensions of the various features may be arbitrarily increased or reduced for clarity of discussion.

DETAILED DESCRIPTION OF THE INVENTION

Figure 1:
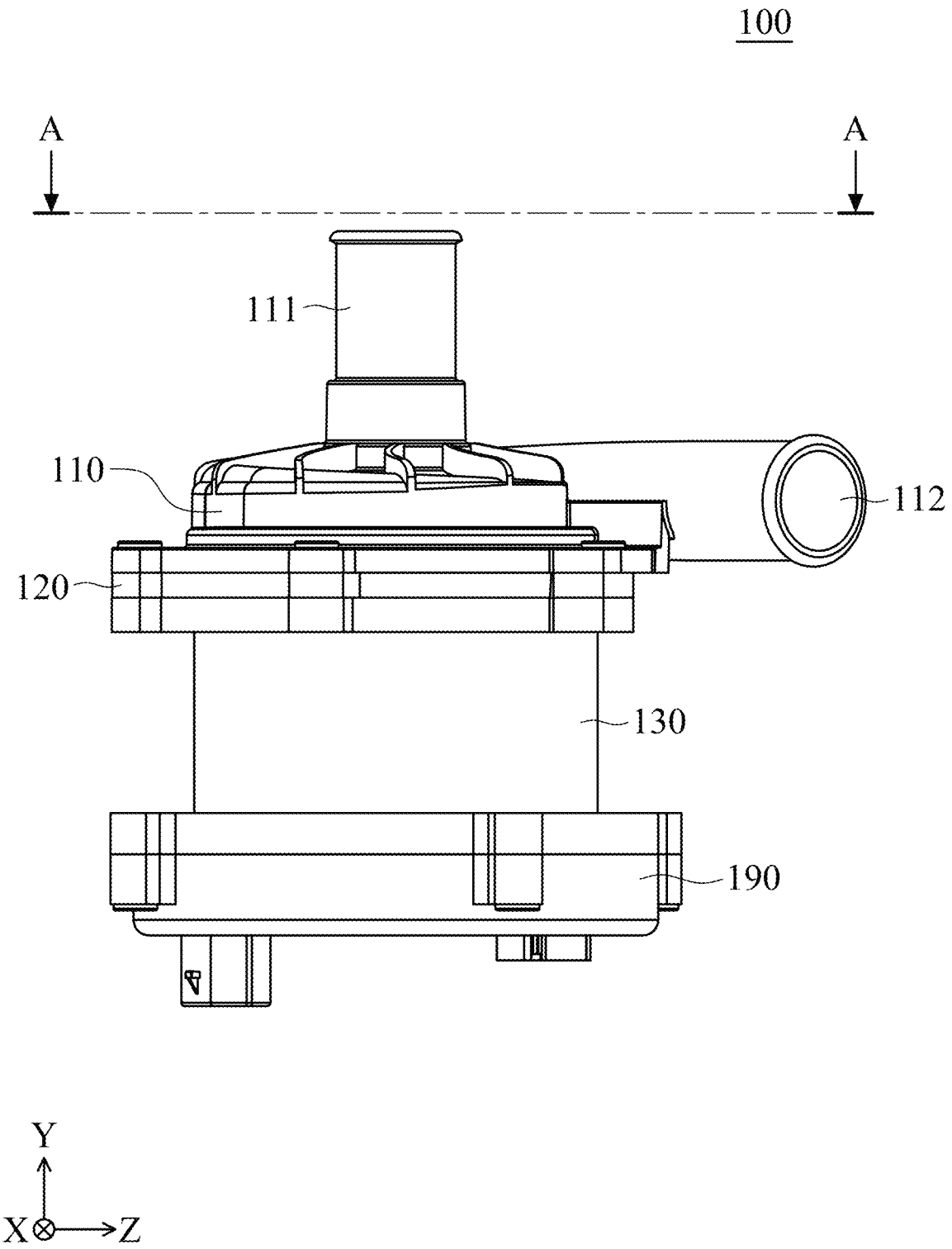
FIG. 1 shows a side view of the water pump housing structure, according to some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact.

In addition, the present disclosure may repeat reference numerals and/or letters in the various embodiments. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "vertical," "above," "over," "below,", "bottom," etc. as well as derivatives thereof (e.g., "downwardly," "upwardly," etc.) are used for ease of the present disclosure of one features relationship to another feature. The spatially relative terms are intended to cover different orientations of the device including the features.

Figure 2:
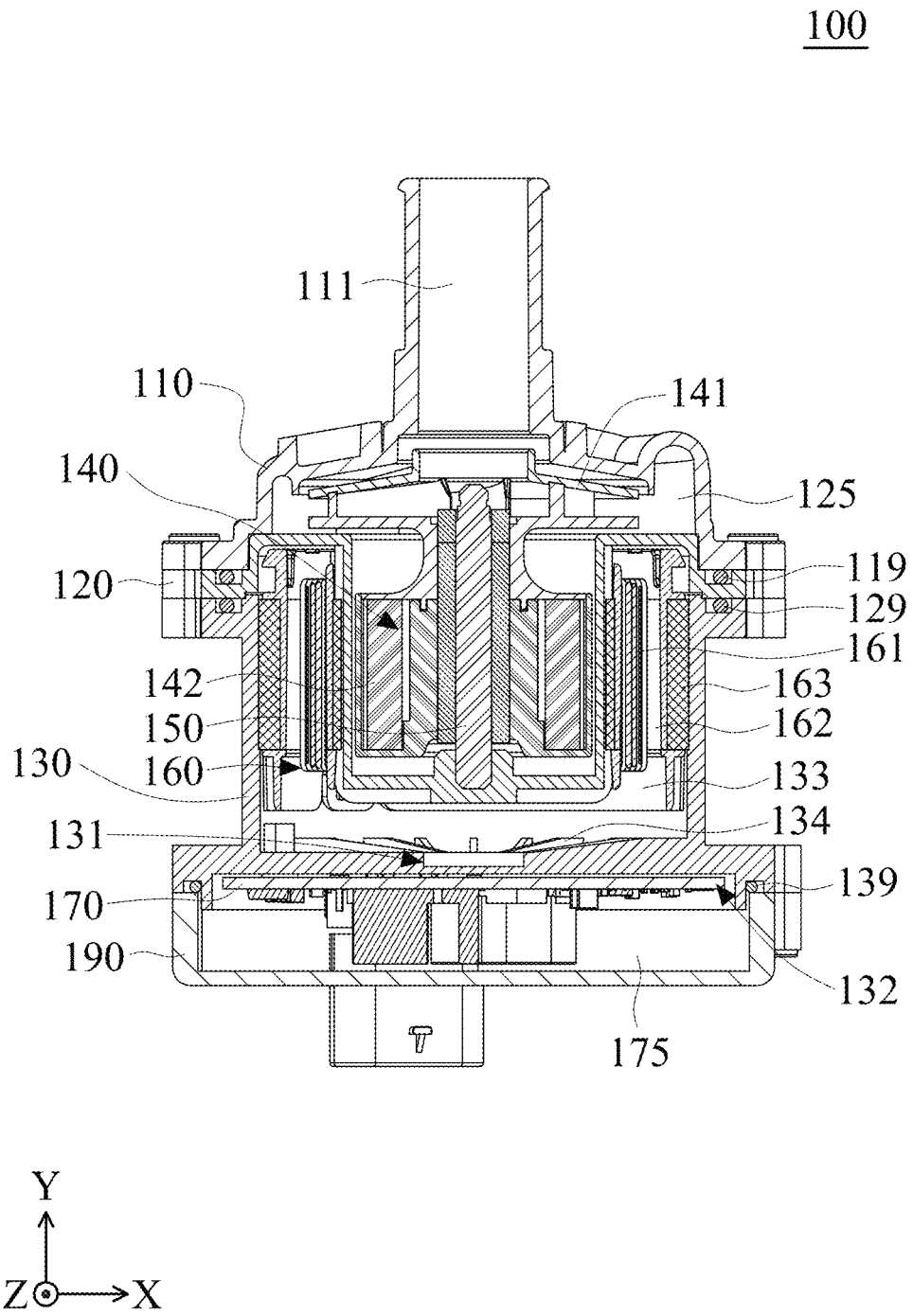
FIG. 2 shows a front cross-sectional view of the water pump housing structure along line A-A in FIG. 1, according to some embodiments of the present disclosure.

First, referring to FIGS. 1 and 2, FIGS. 1 and 2 respectively show a side view and a front cross-sectional view of the water pump housing structure 100, according to some embodiments of the present disclosure. As shown in FIG. 1, the water pump housing structure 100 mainly includes a first housing 110, a second housing 120, and a third housing 130.

In some embodiments, the first housing 110 has an inlet 111 and an outlet 112. The second housing 120, along with the first housing 110, forms a flow passage 125, as shown in FIG. 2. The flow passage 125 is in fluid communication with the inlet 111, and the outlet 112 is in fluid communication with the inlet 111 via the flow passage 125. The flow passage 125 serves as a passage for fluid. Fluid enters the water pump housing structure 100 through the inlet 111. After passing through the flow passage 125, fluid leaves the water pump housing structure 100 through the outlet 112.

The water pump housing structure 100 further includes a rotor 140 and a rotation shaft 150. As shown in FIG. 2, the rotor 140 is located inside the flow passage 125, and the rotation shaft 150 is located at the center of rotation of the rotor 140. In some embodiments, the rotor 140 includes an impeller portion 141 and a rotor magnet portion 142. The impeller portion 141 is linked to the rotor magnet portion 142. In some embodiments, the impeller portion 141 and the rotor magnet portion 142 are aligned on the same axis. The rotor magnet portion 142 drives the impeller portion 141 to rotate with respect to the rotation shaft 150, so that the impeller portion 141 drives the fluid that passes through the flow passage 125 to flow.

As shown in FIG. 2, the rotation shaft 150 may be aligned with the inlet 111 of the first housing 110 on the same axis. In some embodiments, the rotation shaft 150 is not synchronized with the rotor 140. For example, the rotation shaft 150 may be affixed to the second housing 120, so that the rotation shaft 150 remains stationary when the rotor 140 rotates. As such, the heat generated by the rotor 140 may be reduced, thus the operating time further increases.

Still referring to FIG. 2, the third housing 130 has an inner surface 131 and an outer surface 132. The inner surface 131, along with the second housing 120, forms a stator chamber 133. In some embodiments, the water pump housing structure 100 further comprises a stator 160 that is located inside the stator chamber 133. The stator 160 makes the rotor 140 rotate. Specifically, the stator 160 includes a stator magnetic pole 161. The stator magnetic pole 161 is located inside the stator chamber 133 as well.

In some embodiments, the stator magnetic pole 161 may be composed of a plurality of coils. In some embodiments according to the present disclosure, the stator magnetic pole 161 includes a plurality of coils around the second housing 120, and the position of the stator magnetic pole 161 corresponds to the rotor magnet portion 142 of the rotor 140. During operation, power is supplied to the stator magnetic pole 161 and drives the rotor magnet portion 142 to rotate, thereby driving the impeller portion 141 of the rotor 140 to rotate.

In some embodiments, the stator chamber 133 is not in fluid communication with the flow passage 125, which means that fluid does not go into the stator chamber 133. As such, the stator 160 is located in a water-proof space. It is not affected by the flowing fluid. Stability is improved.

As shown in FIG. 2, a fin structure 134 is formed on the inner surface 131 of the third housing 130. The fin structure 134 protrudes from the inner surface 131 toward the stator chamber 133, so that the fin structure 134 is close to the stator magnetic pole 161, which helps cooling the stator 160 and the rotor 140. In some embodiments, the fin structure 134 may be formed integrally with the third housing 130. For example, the third housing may be made from metal. During the forming process, the fin structure 134 may be formed together using a die casting mold. Compared with traditional housing structures, the third housing 130 according to the present disclosure enhances the structural strength with its weight reduced. The fin structure 134 is helpful for the cooling of the water pump housing structure 100, preventing heat accumulation during the operating process and increasing the operating time under normal efficiency. In addition, disposing the fin structure 134 also improves the noise or vibration of the whole structure and enhances the durability of the product. The detailed configuration of the fin structure 134 will be described below in reference to the drawings.

In some embodiments, the water pump structure 100 further includes a circuit board, such as the circuit board 170 shown in FIG. 2, which is covered and protected by a circuit board housing 190. The circuit board housing 190 may be connected to the third housing 130 and located on the other side of the second housing 120. Specifically, the circuit board 170 is located on the outer surface 132 and electrically connected to the stator 160. That is, the circuit board 170 and the fin structure 134 are located on different sides of the third housing 130. The outer surface 132, along with the circuit board housing 190, forms a circuit board chamber 175. The circuit board 170 is placed inside the circuit board chamber 175.

Figure 3:
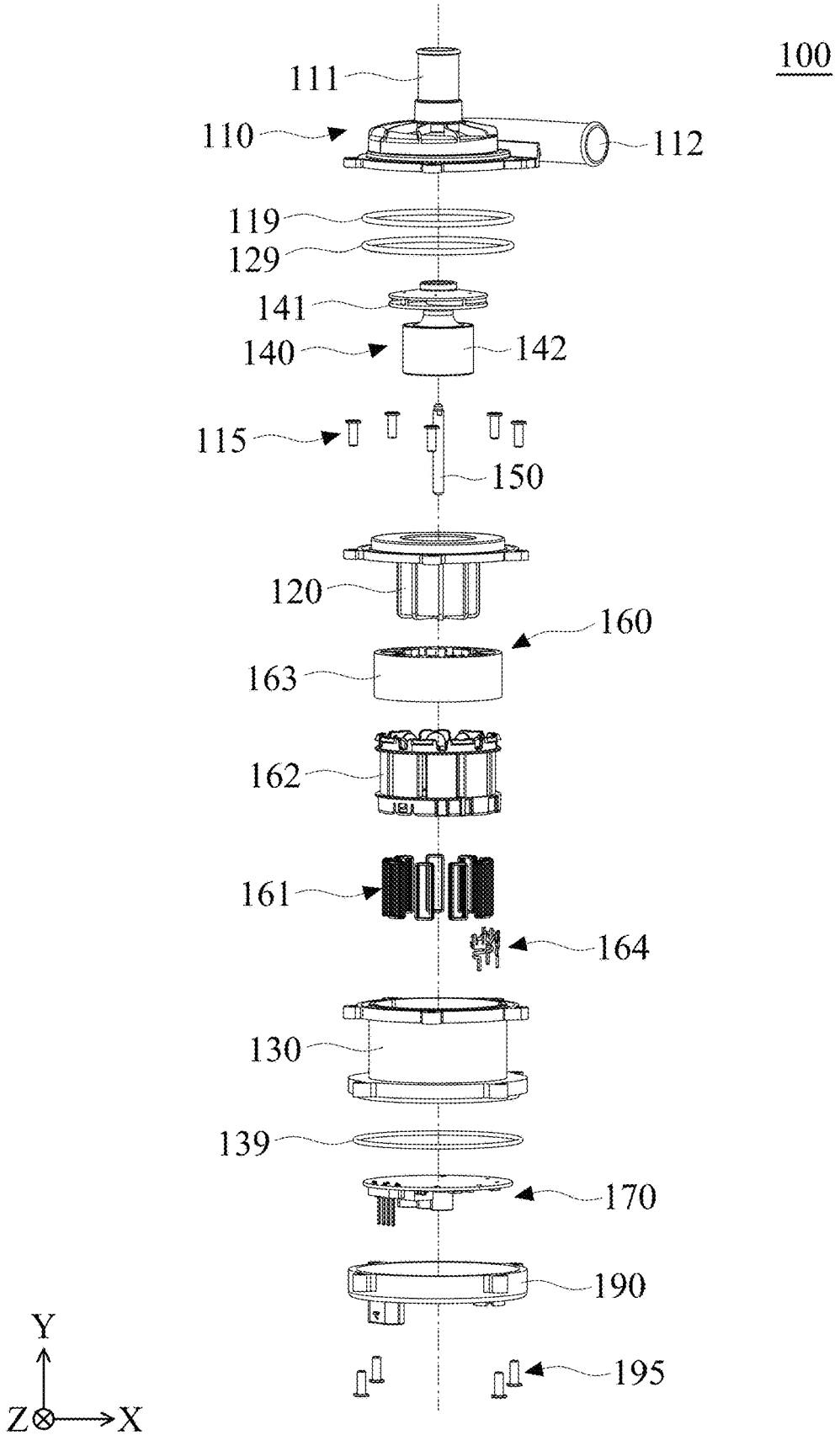
FIG. 3 shows an exploded view of the water pump housing structure, according to some embodiments of the present disclosure.

Next, the assembly details of the water pump housing structure 100 are further illustrated with reference to FIG. 3. FIG. 3 shows an exploded view of the water pump housing structure 100, according to some embodiments of the present disclosure. As shown in FIG. 3, water pump housing structure 100 may further include a plurality of first fasteners 115 and a plurality of second fasteners 195.

The first fasteners 115 are used for connecting the first housing 110, the second housing 120, and the third housing 130. For example, the first fasteners 115 may be bolts, which fasten the first housing 110, the second housing 120, and the third housing 130 together by going through the openings on the first housing 110, the second housing 120, and the third housing 130. In the embodiment shown in FIG. 3, the water pump housing structure 100 includes five of the first fasteners 115 around the circumference of the housings. However, the type, number, and position of the first fasteners 115 are not limited thereto. They may have any suitable type, number, and position.

The second fasteners 195 are used for connecting the third housing 130 and the circuit board housing 190. For example, the second fasteners 195 may be bolts, which fasten the third housing 130 and the circuit board housing 190 together by going through the third housing 130 and the circuit board housing 190. In the embodiment shown in FIG. 3, the water pump housing structure 100 includes four of the second fasteners 195 around the circumference of the housings. However, the type, number, and position of the second fasteners 195 are not limited thereto. They may have any suitable type, number, and position.

The water pump housing structure 100 may further include a first seal ring 119, a second seal ring 129, and a third seal ring 139. Each of the first seal ring 119, the second seal ring 129, and the third seal ring 139 may be an O-ring. The first seal ring 119 is disposed between the first housing 110 and the second housing 120 (see FIG. 2) to ensure that the fluid in the flow passage 125 would not leak into the stator chamber 133. The second seal ring 129 is disposed between the second housing 120 and the third housing 130 (see FIG. 2) to further ensure the impermeability of the stator chamber 133 and protect the stator 160. The third seal ring 139 is disposed between the third housing 130 and the circuit board housing 190 (see FIG. 2) to ensure the impermeability of the circuit board chamber 175 and protect the circuit board 170.

In addition, as shown in FIG. 3, the stator 160 further includes an inner stator housing 162, an outer stator housing 163, and a plurality of stator pins 164. The stator magnetic pole 161 (i.e. coils) are fixedly disposed inside the inner stator housing 162. The inner stator housing 162 not only positions the stator magnetic pole 161, but also serves as a protective layer for the stator magnetic pole 161, thus improving the stability of the stator 160. The outer stator housing 163 is sleeved on the outside of the inner stator housing 162 (see FIG. 2). The outer stator housing 163 may serve as a heat transfer layer for the stator 160 that is helpful for cooling the stator 160, further improving the operating time under normal efficiency. The stator pins 164 may be used for connecting the stator 160 to a power supply. As mentioned, the circuit board 170 is electrically connected to the stator 160. The circuit board 170 is electrically connected to stator 160 via the stator pins 164. Although the stator 160 and the circuit board 170 are located on different sides of the third housing 130, the stator pins 164 may pass through the third housing 130 and connect with the circuit board 170 that is located on the other side of the third housing 130.

In addition, as shown in FIG. 3, the circuit board 170 may also have a plurality of pins for connecting with an outer power supply (not shown). Correspondingly, the circuit board housing 190 may have an accommodating portion that protrudes downward in the drawing for accommodating the pins of the circuit board 170.

Figure 4:
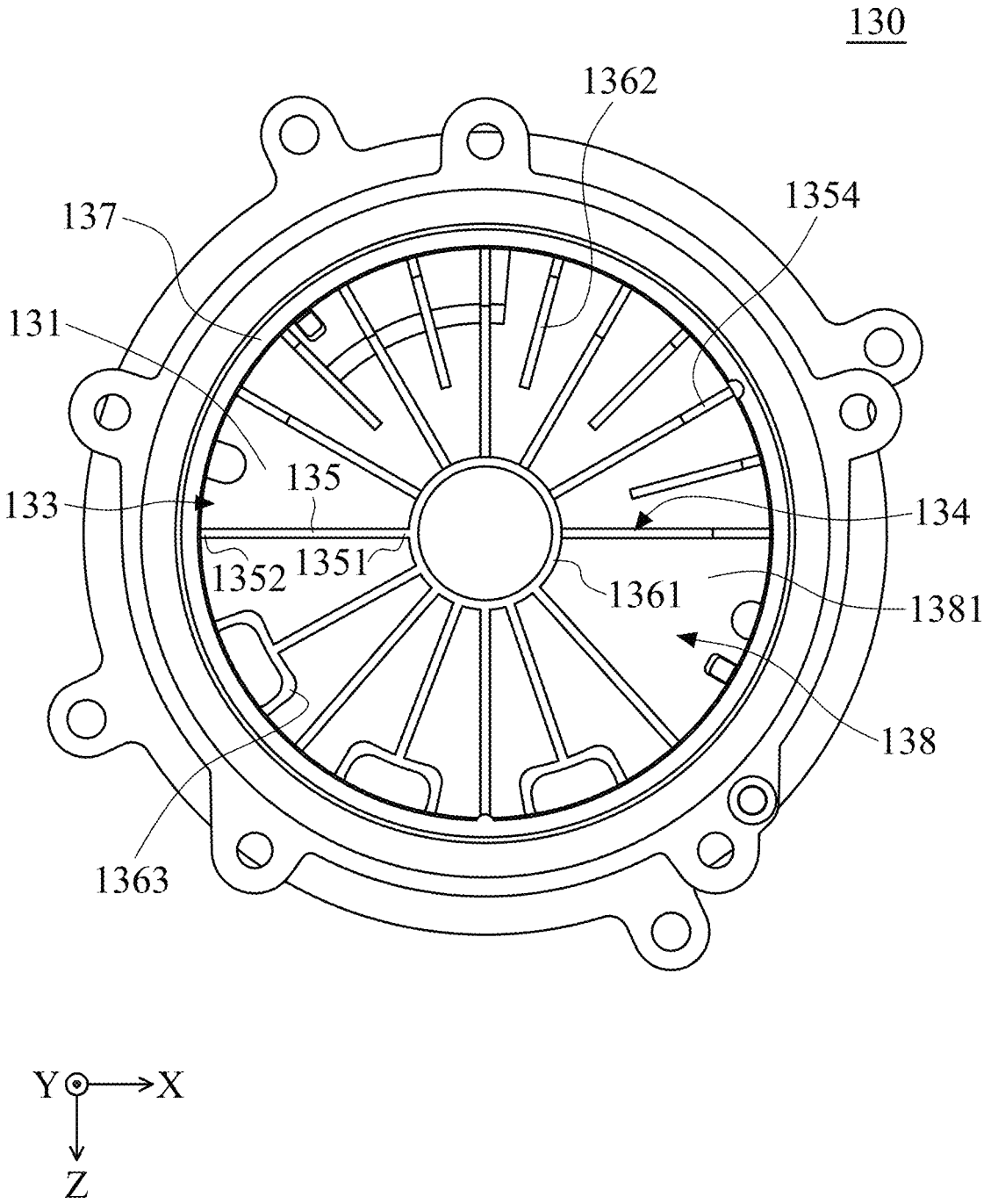
FIG. 4 shows a top view of the third housing of the water pump housing structure, according to some embodiments of the present disclosure.
Figure 5:
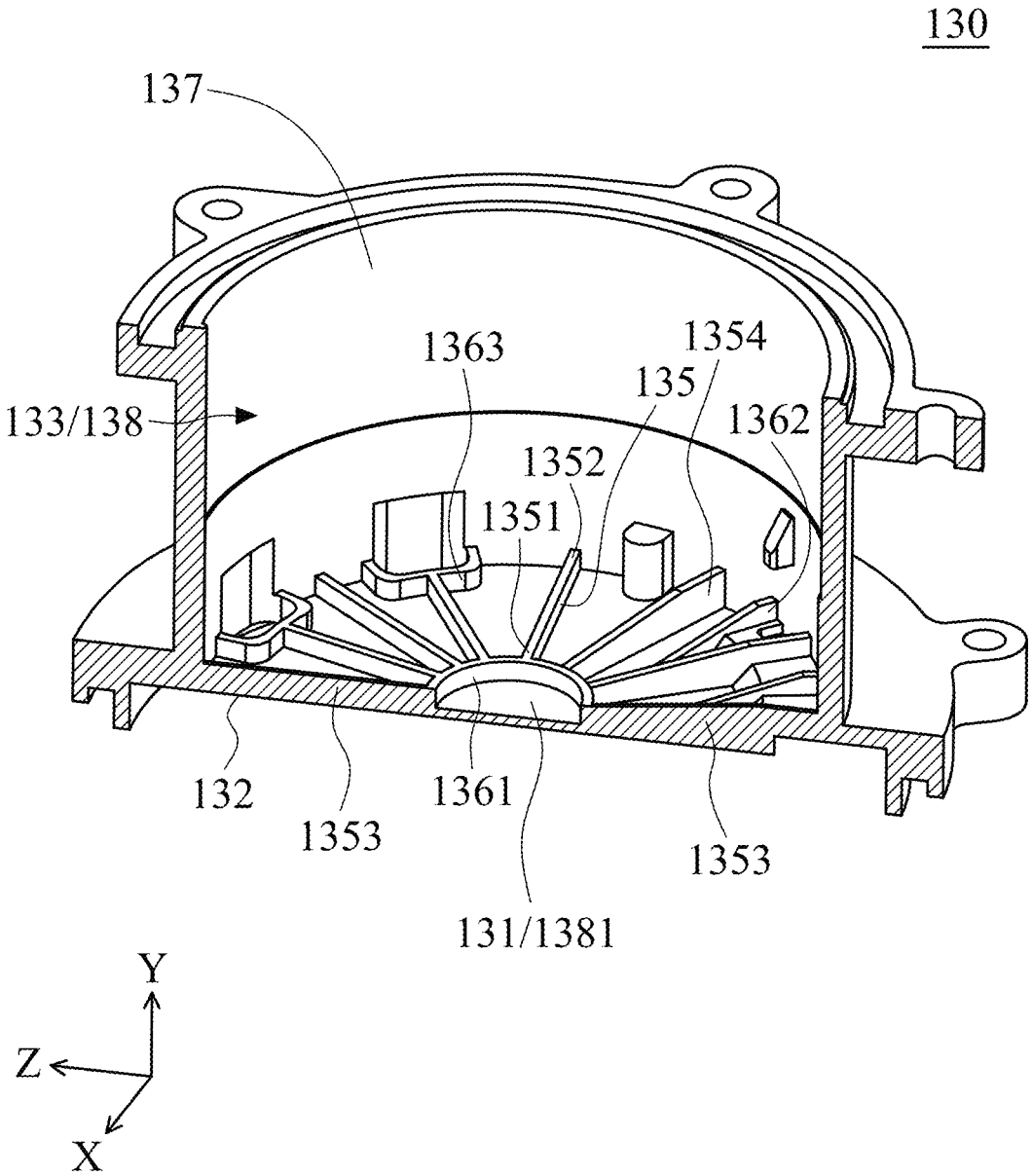
FIG. 5 shows a perspective cross-sectional view of the third housing of the water pump housing structure, according to some embodiments of the present disclosure.

Next, the shape and configuration of the fin structure 134 are illustrated with reference to FIGS. 4 and 5. FIGS. 4 and 5 respectively show a top view and a perspective cross-sectional view of the third housing 130 of the water pump housing structure 100, according to some embodiments of the present disclosure.

As shown in the drawings, the third 130 further include a peripheral portion 137. The peripheral portion 137 surrounds the inner surface 131. The peripheral portion 137 preferably serves as an outer sidewall of the third housing 130, encompassing the stator chamber 133. Therefore, the third housing 130 may also be considered as having a first recess 138 that, along with the second housing 120, forms said stator chamber 133. In this case, the bottom surface 1381 of the first recess 138 corresponds to the inner surface 131 of the third housing 130 described above.

As mentioned, the fin structure 134 protrudes from the inner surface 131 (or the bottom surface 1381) toward the stator chamber 133. As shown in FIGS. 4 and 5, the fin structure 134 has a plurality of elongated portions 135. Every extending direction of the elongated portions is not perpendicular to the inner surface 131 (or the bottom surface 1381). For example, in the embodiments shown in FIGS. 4 and 5, the elongated portions 135 are arranged radially. The elongated portions 135 extends in parallel from the peripheral portion 137 and the inner surface 131 (or the bottom surface 1381) to the center of the third housing 130.

Every elongated portion 135 has a proximal end 1351, a distal end 1352, and a side portion 1353. The proximal end 1351 and the distal end 1352 are connected by the side portion 1353. The side portion 1353 is connected to the inner surface 131 (or the bottom surface 1381). In the embodiments shown in FIGS. 4 and 5, the angle between the side portion 1353 and the inner surface 131 (or the bottom surface 1381) is a right angle. As shown in the drawings, every proximal end 1351 of the elongated portions 135 is away from the peripheral portion 137, and every distal end 1352 of the elongated portions 135 is connected to the peripheral portion 137. As such, the operational efficiency of the water pump may be further enhanced.

In some embodiments, the fin structure 134 may further include a ring-shaped portion 1361. The ring-shaped portion 1361 is located at the center of the third housing 130. The proximal ends 1351 of some of the elongated portions 135 may be connected to the ring-shaped portion 1361, while the proximal ends 1351 of other elongated portions 135 are not connected to the ring-shaped portion 1361. Those elongated portions 135 whose proximal ends are not connected to the ring-shaped portion 1361 are also referred to as shorter elongated portions 1362. Shorter elongated portions 1362 may be placed between the longer elongated portions 135. However, not every two adjacent elongated portions 135 have a shorter elongated portion 1362 between them. The number and positions of the shorter elongated portions 1362 are not limited to those shown in the embodiment of FIG. 4. Suitable number and positions may be chosen according to user requirements.

In some embodiments, the heights of some elongated portions 135 remain the same, while other elongated portions 135 has a raised portion 1354. As shown in FIG. 5, the height of the raised portion 1354 gradually increases from the center of the third housing 130 toward the peripheral portion 137. It should be noted that shorter elongated portions 1362 may also have raised portions 1354. Additionally, the lengths of the raised portions 1354 of the shorter elongated portions 1362 are shorter than those of the raised portions 1354 of the elongated portions 135. The fins that have a raised portion 1354 has a larger surface area, which is beneficial to improve the cooling efficiency. The number and positions of the raised portions 1354 are not limited to those shown in the embodiment of FIG. 4. Suitable number and positions may be chosen according to user requirements.

In some embodiments, the distal ends 1352 of some elongated portions 135 may have an opening portion 1363. As mentioned, the stator pins 164 of the stator 160 need to pass through the third housing 130 in order to connect with the circuit board 170. Therefore, the inner surface (or the bottom surface 1381) of the third housing 130 may have one or more openings. In the embodiment shown in FIG. 4, there are three openings, but the number of the openings may be chosen based on actual needs. Corresponding to the positions of the openings, the opening portions 1363 of the elongated portions 135 may encompass said openings, forming U-shaped structures. As such, the formation of the fin structure 134 is not affected by the openings. Instead, it further increases the surface area and enhances the cooling efficiency.

According to some embodiments of the present disclosure, the fin structure 134 is composed of linear fins (e.g. the elongated portions 135) and curved fins (e.g. the ring-shaped portion 1361 and the opening portions 1363), and is disposed on the surface of the third housing 130 that faces the stator 160. Although the shape and configuration of the fin structure 134 are disclosed in the embodiments shown in FIGS. 4 and 5, the shape and configuration of the fin structure 134 may be determined based on the actual size of the third housing 130, the distance from the stator 160, the position of the circuit board 170, etc. They are not limited to those shown in the embodiments of FIGS. 4 and 5. The fin structure 134 may enhance the cooling effect of the water pump housing structure 100, solving the problem of reducing the operating time due to overheating during operation.

In summary, by disposing the fin structure 134 protruding toward the stator chamber 133 on the inner surface 131 of the third housing 130, so that the fin structure 134 faces and is close to the stator 160 and the rotor 140, the cooling efficiency of the water pump housing structure 100 may be improved significantly. On the other hand, within the same operating time, it improves the operation efficiency. In addition, since the fin structure 134 is disposed on the inner surface 131 of the third housing 130, the fin structure 134 is not exposed to the exterior of the third housing 130 and is protected by the third housing 130. It does not affect the installment or connection of the circuit board 170. Therefore, the water pump housing structure 100 of the present disclosure offers the advantages of increased operating time, improved efficiency, longer service life, and improved structural configurations.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A water pump housing structure, comprising:

a first housing that has an inlet;

a second housing that, along with the first housing, forms a flow passage, wherein the flow passage is in fluid communication with the inlet, serving as a passage for fluid;

a third housing that has an inner surface and an outer surface, wherein the inner surface, along with the second housing, forms a stator chamber, a fin structure is formed on the inner surface, and the fin structure protrudes from the inner surface toward the stator chamber;

a rotor that is located inside the flow passage; and a stator that is located inside the stator chamber and drives the rotor to rotate.

2. The water pump housing structure as claimed in claim 1, wherein the rotor has an impeller portion and a rotor magnet portion, wherein the impeller portion is linked to the rotor magnet portion.

3. The water pump housing structure as claimed in claim 1, wherein the stator comprises a stator magnetic pole that is located inside the stator chamber.

4. The water pump housing structure as claimed in claim 1, wherein the stator chamber is not in fluid communication with the flow passage.

5. The water pump housing structure as claimed in claim 1, wherein the first housing further comprises an outlet that is in fluid communication with the inlet via the flow passage.

6. The water pump housing structure as claimed in claim 1, further comprising a rotation shaft that is located at a center of rotation of the rotor, wherein the rotation shaft is not synchronized with the rotor.

7. The water pump housing structure as claimed in claim 1, further comprising a circuit board that is located on the outer surface, wherein the circuit board is electrically connected to the stator.

8. The water pump housing structure as claimed in claim 1, wherein the third housing further comprises a peripheral portion that surrounds the inner surface.

9. The water pump housing structure as claimed in claim 8, wherein the fin structure has a plurality of elongated portions, wherein every extending direction of the elongated portions is not perpendicular to the inner surface, every proximal end of the elongated portions is away from the peripheral portion, and every distal end of the elongated portions is connected to the peripheral portion.

10. The water pump housing structure as claimed in claim 9, wherein every elongated portion further comprises a side portion, wherein each one of the proximal ends and each one of the distal ends are connected via the side portion, and the side portions are connected to the inner surface.

11. A water pump housing structure, comprising:

a first housing that has an inlet;

a second housing that, along with the first housing, forms a flow passage wherein the flow passage is in fluid communication with the inlet and serves as a passage for fluid;

a third housing that has an first recess, wherein the first recess, along with the second housing, forms a stator chamber, a fin structure is formed on a bottom surface of the first recess that faces the stator chamber, and the fin structure protrudes from the bottom surface toward the stator chamber;

a rotor that is located inside the flow passage; and a stator that is located inside the stator chamber and drives the rotor to rotate.

12. The water pump housing structure as claimed in claim 11, wherein the rotor has an impeller portion and a rotor magnet portion, wherein the impeller portion is linked to the rotor magnet portion.

13. The water pump housing structure as claimed in claim 11, wherein the stator comprises a stator magnetic pole that is located inside the stator chamber.

14. The water pump housing structure as claimed in claim 11, wherein the stator chamber is not in fluid communication with the flow passage.

15. The water pump housing structure as claimed in claim 11, wherein the first housing further comprises an outlet that is in fluid communication with the inlet via the flow passage.

16. The water pump housing structure as claimed in claim 11, further comprising a rotation shaft that is located at the center of rotation of the rotor, wherein the rotation shaft is not synchronized with the rotor.

17. The water pump housing structure as claimed in claim 11, further comprising a circuit board, and the third housing further comprises an outer surface that is not inside the first recess, wherein the circuit board is located on the outer surface, wherein the circuit board is electrically connected to the stator.

18. The water pump housing structure as claimed in claim 11, wherein the first recess further comprises a peripheral portion that surrounds the bottom surface.

19. The water pump housing structure as claimed in claim 18, wherein the fin structure has a plurality of elongated portions, wherein every extending direction of the elongated portions is not perpendicular to the bottom surface, every proximal end of the elongated portions is away from the peripheral portion, and every distal end of the elongated portions is connected to the peripheral portion.

20. The water pump housing structure as claimed in claim 19, wherein every elongated portion further comprises a side portion, wherein each one of the proximal ends and each one of the distal ends are connected via the side portion, and the side portions are connected to the bottom surface.

* * * * *